US006772548B1

(12) United States Patent
Power

(10) Patent No.: US 6,772,548 B1
(45) Date of Patent: Aug. 10, 2004

(54) TRIGGER ASSEMBLY FOR AK47 TYPE RIFLE

(76) Inventor: Ronald Power, 29739 Highway J, Gravois Mills, MO (US) 65037

( * ) Notice: Subject to any disclaimer, the term of this patent is extended or adjusted under 35 U.S.C. 154(b) by 0 days.

(21) Appl. No.: 10/421,203

(22) Filed: Apr. 22, 2003

Related U.S. Application Data

(60) Provisional application No. 60/374,792, filed on Apr. 22, 2002.

(51) Int. Cl.[7] ..... F41A 19/10; F41A 19/42

(52) U.S. Cl. ..... 42/69.03; 89/148; 89/139

(58) Field of Search ..... 42/69.01, 69.03; 89/148, 150, 154, 142, 132, 139

(56) References Cited

U.S. PATENT DOCUMENTS 2,361,519 A * 10/1944 Williams ..... 89/139
4,023,465 A * 5/1977 Inskip ..... 89/131
4,522,106 A * 6/1985 Sullivan ..... 89/140
4,594,934 A * 6/1986 Holstein et al. ..... 89/129.02
5,274,939 A * 1/1994 Scaramucci et al. ..... 42/69.03
5,501,134 A * 3/1996 Milazzo et al. ..... 89/139
5,881,485 A * 3/1999 Milazzo ..... 42/70.08
5,900,577 A * 5/1999 Robinson et al. ..... 89/191.01
6,131,324 A * 10/2000 Jewell ..... 42/69.03

* cited by examiner

*Primary Examiner*—Charles T. Jordan
*Assistant Examiner*—John W. Zerr
(74) *Attorney, Agent, or Firm*—Donn K. Harms

(57) ABSTRACT

An adjustable trigger assembly adapted for installation into the carrier of an AK-47 and similar rifles. The assembly features a plurality of adjusting screws to adjust the force required for trigger pull, the over travel of the trigger after firing, and the forward rotational force and angle of a disconnector rotationally engaged in a slot in the trigger to thereby allow for adjustment of the force required during both stages of pull of a two stage trigger to fire the weapon. The device is adapted for engagement with the receiver of a conventional AK-47 in replacement of the original trigger mechanism and may be used with the original hammer or optionally may employ a replacement hammer which features limited contact with the trigger assembly to lessen the trigger pull required for firing.

18 Claims, 3 Drawing Sheets

TRIGGER ASSEMBLY FOR AK47 TYPE RIFLE

This application claims the benefit of U.S. Provisional Application No. 60/374,792 filed Apr. 22, 2002.

FIELD OF THE INVENTION

This invention relates to the field of trigger activated rifles. More particularly it relates to an adjustable trigger mechanism for use in combination with the AK47 family of Rifles.

BACKGROUND OF THE INVENTION

The Kalashnikov assault rifle, also known as the AK-47 (Avtomat Kalashnikova-47, Kalashnikov automatic rifle, model of 1947), and its derivatives, also known under the common name of AK, is the most prolific small arm of the $2^{nd}$ half of the 20th century. It had been and still is (in more or less modified forms) manufactured in dozens of countries, and used in hundreds of countries and conflicts since its introduction. The total number of the AK-type rifles made worldwide during the last 50 years is estimated at 90+ millions. This is a true legendary weapon, known for its extreme ruggedness, simplicity of operation and maintenance, and unsurpassed reliability even in worst conditions possible. It is used not only as a military weapon, but also as a platform for numerous sporting civilian rifles.

The AKM is a gas operated, selective fire assault rifle. The gas operated action has a bolt carrier permanently attached to a long stroke gas piston. The gas chamber is located above the barrel. The bolt carrier rides on the two rails, machined in the receiver, with the significant clearances between the moving and stationary parts, allowing the gun to operate even when its interior is severely fouled with sand or mud.

The rotating bolt has two massive lugs that lock into the receiver. This bolt is so designed that on the unlocking rotation it also makes a primary extraction movement to the fired case. This results in a very positive and reliable extraction even with dirty chamber and cases. The rotation of the bolt is ensured by the curved cam track, machined in the bolt carrier, and by the appropriate stud on the bolt itself. The return spring and a spring guide are located behind the gas piston and are partially hidden in its hollow rear part when bolt is in battery. The return spring base also serves as a receiver cover lock. The cocking handle is permanently attached to the bolt carrier (in fact, it forms a single machined steel unit with carrier), and does reciprocate when gun is fired.

The receiver of the AKM is made from the stamped sheet steel, with machined steel inserts riveted into the place where required and houses the trigger mechanism. The relatively simple trigger/hammer mechanism features a hammer with two sears. A first or main sear mounted on the trigger extension. A second sear for the semi-automatic fire intercepts the hammer in the cocking position after the shot is fired and until the trigger is released.

The AKM trigger unit also featured a hammer release delay device, which is served to delay the hammer release in the full auto fire by few microseconds. This does not affect the cyclic rate of fire, but allows the bolt group to settle in the forward most position after returning into the battery. A combined safety and fire selector switch is located on the right side of the receiver and varies in operation as a safety to prevent fire of the weapon and also to allow semi and fully automatic operation by changing position.

While built to be a reliable performer even in dirty environments, the large tolerances built into the receiver mounted trigger assembly yield a trigger action that is loose, crude and lacks any components which would allow adjustement of the aspects of trigger pull to the individual marksman's requirements. The trigger provided with conventional AK-47 rifles and its derivitives is a simple pull and shoot device where pulling the trigger activates the hammer which communicates with adjacent parts to fire the weapon. It lacks any ajustment for overtravel, tension or trigger pull, or the engagement of the trigger with the hammer.

As such, there exists a need for a trigger mechanisim that is easily installed in the AK-47 type rifle and its derivitives that easily replaces the original trigger. Such a device should be easily installed in the receiver of the rifle by removing the stock trigger mechanism and replacing it. Such a trigger mechanism should allow for easy adjustment of the over travel of the trigger, the engagement of the trigger with the hammer communicating with the firing pin, and the trigger pull force required to actually rotate the trigger to the firing position.

SUMMARY OF THE INVENTION

The device herein disclosed is an improved and adjustable trigger mechanism that is easily installed and submitted for the factory provided receiver mounted trigger mechanism in the AK-47 family of rifles. The operation of conventional AK-47 rifles is well known to those skilled in the art and need not be described in detail other than that such rifles control fire of the bullets from the cartridge using a trigger assembly that cooperatively engages with a hammer which communicates the firing action to the firing pin when released by the trigger mechanism. The hammer once released by the receiver mounted trigger mechanism rotates to causes the weapon to fire with the weapon then re-cocking the hammer using the power of the discharge to place it in position to fire again once the hammer is released.

The herein disclosed adjustable trigger assembly is manufactured to mount directly into the conventional receiver used to operatively engage the trigger assembly with the hammer in the AK-47 family of rifles. It is provided with a two-piece trigger assembly and can be used with the conventional hammer or in the preferred mode with a provided hammer which better cooperatively engages with the trigger assembly. It is best manufactured by machining the components from steel bar stock and in order to insure long and trouble free operation the components so manufactured are then heat treated and finished with black oxide. In a final step the parts are hand polished with special attention being made to the hammer and sear engagement areas to allow for a smooth trigger pull. When operatively assembled in place of the original trigger components mounted in the receiver, the disclosed device provides a major improvement in both the basic function of the trigger as well as the ability for multiple and minute adjustments to their operation to satisfy any marksmans concerns and desires. Both the finger-activated trigger and the disconnector pivot as a trigger assembly on the trigger pivot pin which mounts them both into the factory provided original receiver.

The trigger assembly composed of the engaged trigger and disconnector cooperatively engage with a hammer and provide a plurality of adjustment set screws which may be user adjusted to achieve the desired trigger adjustments. A first set screw provides for adjustment of the overtravel or free travel the trigger has once it has disengaged the factory provided hammer which fires the round. A second set screw adjusts the area of engagement of surface between the trigger and hammer thereby adjusting the amount of travel the trigger will have in the first stage of the two stage trigger operation. A third ajustment set screw adjusts the position of the disconnector in relation to the rotation of the trigger thereby determining whether the trigger has two stages of pull or a single stage of pull if so desired. Finally, a fourth adjustment set screw determines the tension of the internally mounted disconnector biasing spring away from the trigger and toward the hammer. If a two-stage trigger is selected, this adjustment provides a means to adjust the pull required in the second stage.

An object of this invention is the provision of an adjustable trigger mechanism for the AK-47 family of rifles, which is easily mounted into the factory-provided receiver to thereby substitute for the original non adjustable trigger.

Another object of this invention is the provision of a trigger mechanisim that is user adjustable for over travel.

An additional object of this invention is the provision of an adjustable trigger mechanism for the AK-47 family of rifles that provides for adjustment of the surface area of engagement between the hammer which fires the round in the chamber and trigger.

A further object of this invention is the provision of an adjustment for the disconnector component of the trigger assembly.

Yet another object of this invention is the provision of a tension adjustment for adjusting the pull required of the trigger to fire an AK-47 style of a rifle.

Still another object of this invention is the provision of multiple means of trigger adjustment that may be individually adjusted in relation to each other to yield a highly customizable trigger operation for the user.

Yet an additional object of this invention is the provision of such multiple adjustments of a trigger mechanisim to allow the user to choose a single stage or two stage trigger pull to discharge the rifle.

These together with other objects and advantages which will become subsequently apparent reside in the details of the construction and operation as more fully hereinafter described and claimed, reference being had to the accompanying drawings forming a part thereof, wherein like numerals refer to like parts throughout.

BRIEF DESCRIPTION OF THE DRAWINGS

The accompanying drawings, which are incorporated in and form a part of this specification, illustrate embodiments of the invention and together with the description, serve to explain the principles of this invention.

DETAILED DESCRIPTION OF THE PREFERRED EMBODIMENTS

Figure 1:
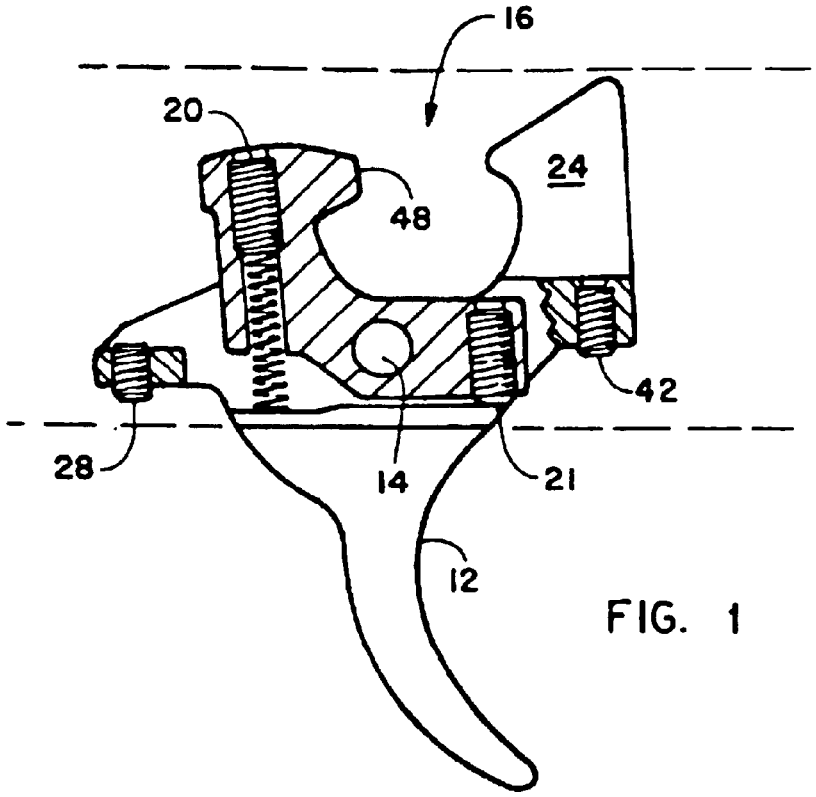
FIG. 1 depicts a side view of the disclosed trigger assembly of an AK-47 rifle with four points of trigger adjustment.

Referring now to the drawings, wherein similar parts of the invention are identified by like reference numerals, there is seen in FIG. 1 depicts the disclosed trigger assembly 10 which is provided and has a plurality of means for adjustment of trigger pull aspects to allow the user to change the manner and operation of the trigger assembly 10 during operation engaged with an AK-47 style of rifle. As depicted, the disclosed 10 provides a plurality of means of adjustment of the trigger mechanism which may be used together or individually to provide an infinite amount of adjustment to the user. While provision of all four adjustment points is the current preferred mode of the trigger assembly 10, it is anticipated that in some instances less than four means for adjustment might be provided and such is anticipated within the scope of this invention.

As shown in figure one the trigger 12 is rotationally engaged on pin 14 which engages with the sidewalls of the receiver 16 which operatively engages into the AK-47 rifle and communicates the action of the trigger to the firing pin to fire the weapon. Rotationally engaged in a slot in the trigger is the disconnector 18 such that the disconnector 18 will rotate in the same direction of the trigger 12 in the receiver 16 when the trigger is pulled. However the disconnector 18 will also rotate in the slot inside the receiver 16 independent of the rotation of the trigger 12 and using the provided adjustment screws 20 and 21 mounted in the disconnector 18 the amount and rate of the rotation of the disconnector 18 in relation to the rotation of the trigger 12 can be adjusted yielding the user configurable adjustability described below.

Figure 2:
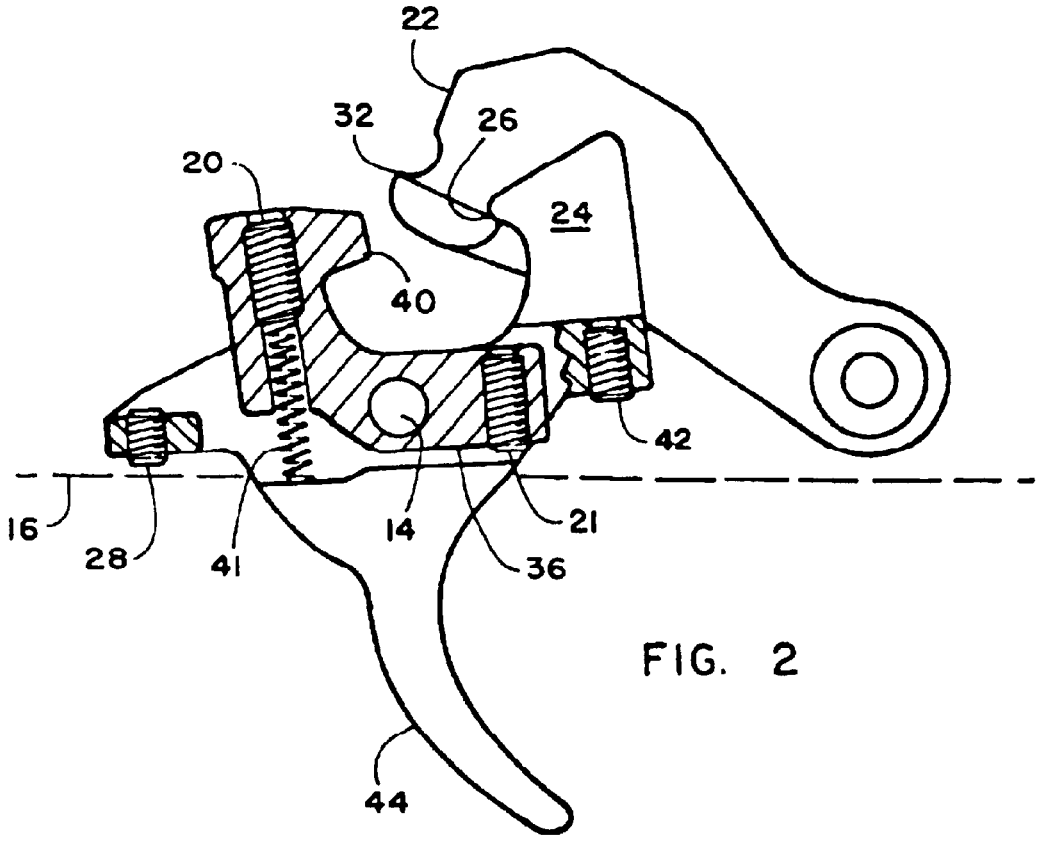
FIG. 2 shows a side view of the disclosed trigger assembly engaged with the hammer of an AK-47 rifle in the cocked position before firing.

FIG. 2 shows a side view of the disclosed trigger assembly 10 engaged with the hammer 22 of an AK-47 rifle in the cocked position before firing of the rifle. A means for adjustment of the amount of overlap of the hook portion 24 of the trigger 12 over the ledge 26 is provided by adjustment screw 28 which is located at the rear of the trigger 12 and may be rotated to project from the trigger 12 and contact the receiver 16 thereby providing a stop for the trigger's rearward rotation. As can be seen, the further the adjustment screw 28 projects from the bottom of the rear of the trigger 12, the more the trigger 12 is rotated forward at it furthest point rotated toward the rear and the less the hook portion 24 overlaps the ledge 26 of the hammer 22. This means to adjust the area of overlap of the hook portion 24 with the ledge 26 of the trigger 12 provides the user a means to adjust the amount of force required to fire the weapon. The less the overlap, the less force required by the trigger finger to fire the weapon. The user can thus adjust the adjustment screw 28 to achieve a hard pull requirement to fire the weapon or a hair trigger, with infinite different points of force in-between.

A means for adjustment to the overlap of latch portion 30 the disconnector 18 and the rear ledge 32 which occurs when the trigger assembly 10 is being re-cocked by the action of the rifle after firing is provided by the adjustment screw 21 mounted in the front portion of the rotating disconnector. This adjustment screw is biased into contact with a ledge 36 formed adjacent to the slot 38 in the trigger 12 which the disconnector occupies. Since the disconnector is rotationally engaged in the slot 38 and is biased by spring 41 toward the ledge 36, translating the adjustment screw 21 outward from the disconnector 18 will cause the adjustment screw 21 to contact the ledge 36 sooner during rotation of the disconnector 18 thereby limiting the total forward rotation. This provides the means for limiting the forward travel of the disconnector 18 in its rotational engagement in the trigger 12 and the resulting adjustment of the overlap of the latch portion 30 with the rear ledge 32 and its contact time with the arched portion 40 by simply screwing the adjustment screw 21 in or out to provide more less or more overlap respectively.

Figure 3:
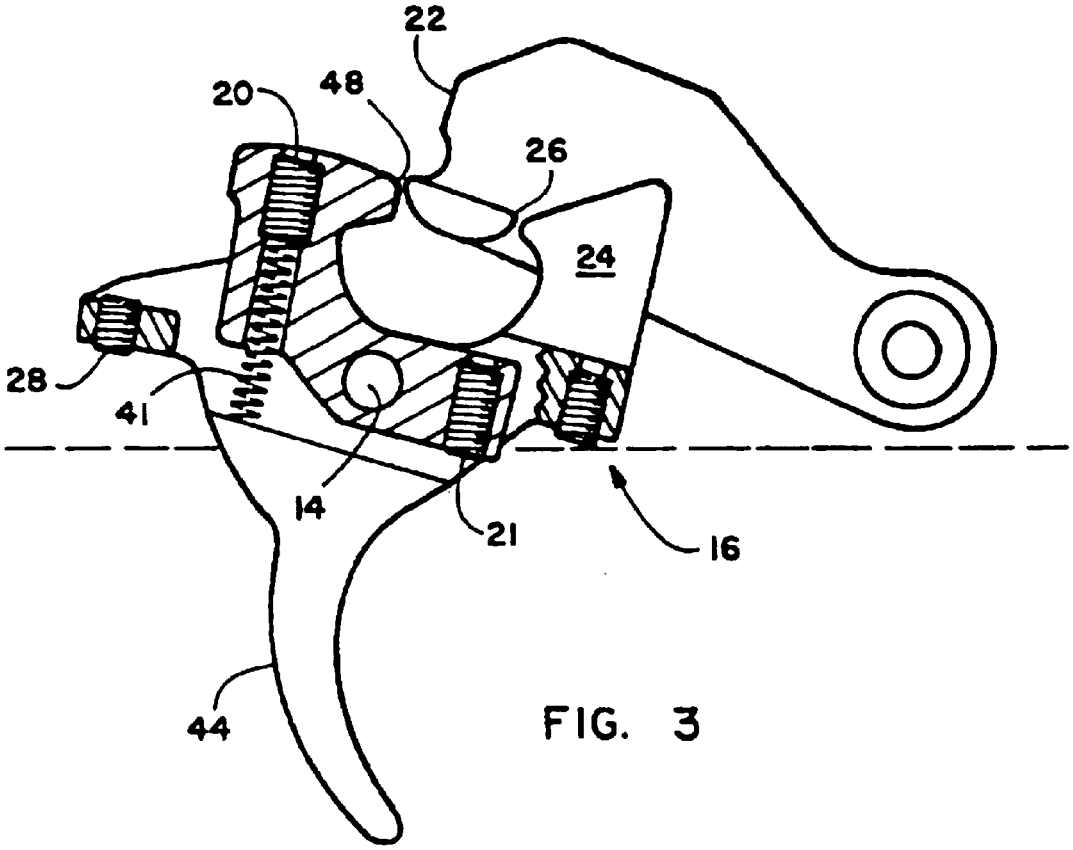
FIG. 3 shows the trigger assembly at the time of firing allowing the hammer to rotate to fire the rifle.

FIG. 3 shows the trigger assembly at the time of firing allowing the hammer 22 to rotate upward and communicate with other components to fire the rifle. A means to adjust the over travel or rearward travel of the trigger 12 is provided by adjusting screw 42 which may be adjusted into and out of its engagement in the bottom forward portion of the trigger 12 such that it contacts the receiver 13 earlier or later during the rotation of the trigger 12. If the adjusting screw protrudes more from the trigger 12 it will contact the receiver 16 earlier and shorten the amount of rearward travel of the trigger 12 and the trigger lever 44.

Figure 4:
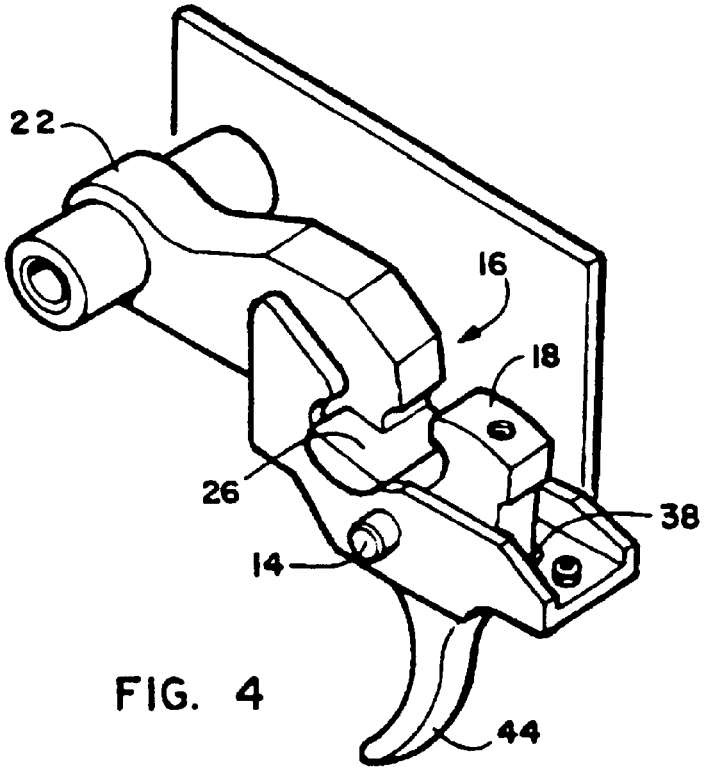
FIG. 4 depicts a perspective view of the components of the trigger assembly in cooperative operational engagement.
Figure 5:
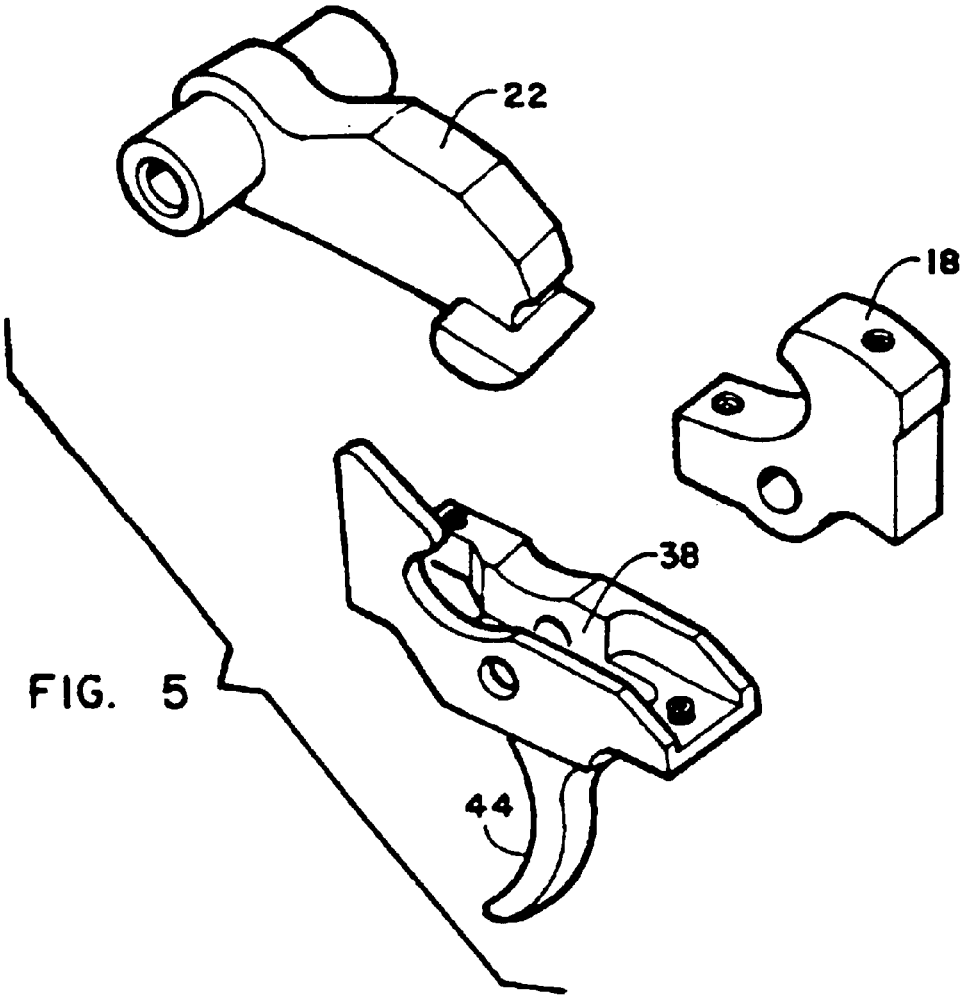
FIG. 5 depicts an exploded view of the trigger and disconnector components making up the trigger assembly.
Figure 6:
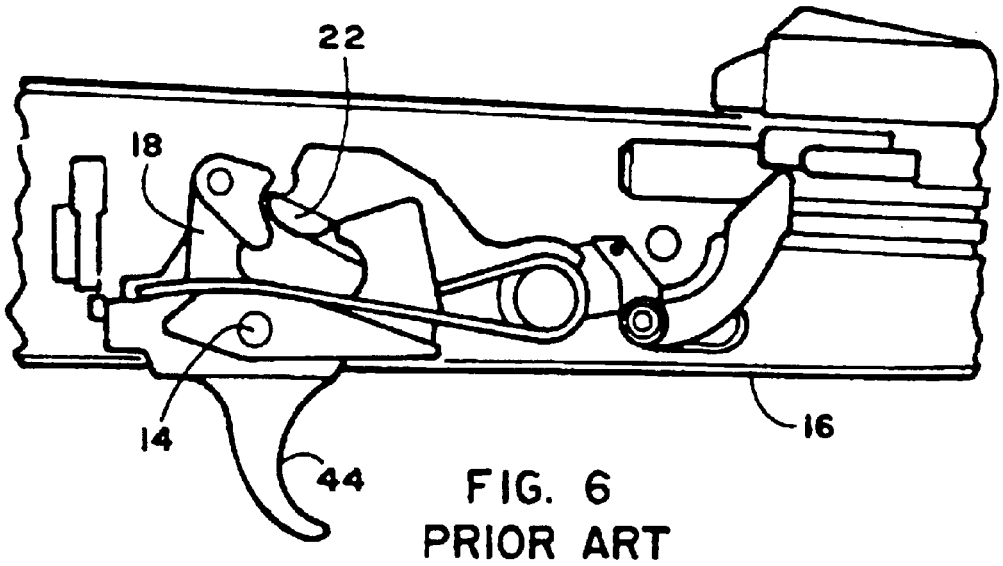
FIG. 6 PRIOR ART
FIG. 6 depicts a prior art rendition showing a conventional AK-47 trigger mechanism mounted in a receiver for activating the firing of the rifle.

FIG. 4 depicts a perspective view of the disconnector 18 engaged in the slot 38 in the trigger 12. Also shown is an optional replacement hammer 46 which has a ledge only one one side of the replacement hammer 46. In the conventional AK-47 trigger components, the hammer has two ledges 26 projecting from both sides of the hammer which engage with two hook portions 24 on the trigger 12. While this is a sturdy engagement of trigger and hammer and is probably required due to the very loose tolerances of the conventional AK-47 trigger mechanism, it was found during lengthy testing, that while the conventional hammer 22 provided with an AK-47 would work well with the disclosed trigger 12 which has only one hook portion 24, that using a hammer with only one ledge 26 significantly improved the action of the trigger assembly 10. As such, in a preferred embodiment of the trigger assembly 10 herein disclosed, a hammer 22 with only a single ledge 26 to match the single hook portion 24 would be provided. But, since the disclosed trigger 12 with only one hook portion 24 would still work much better than the conventional trigger provided on the AK-47, an embodiment without the hammer 22 with one ledge 26 and using the stock hammer is also envisioned withing the scope of this patent.

In operation, the four different means of trigger action adjustment are significant enhancements to the person firing the rifle, especially target and competition shooters who rely on very accurate trigger pull and action. This can be understood by reviewing FIG. 2 which shows the trigger assembly 10 in the cocked and ready to fire position engaged in the receiver 16. When the trigger lever 44 is pulled in the first stage of the two stage trigger, it rotates the trigger 12 thereby starts the disengagement of the trigger hook portion 24 with the ledge 26 on the hammer 22. At this point the hammer 22 begins to rotate and moves to the second stage where the arched portion 40 contacts the front surface 48 of the spring biased disconnector 18 which then holds back the hammer 22 and begins the second stage of the trigger action. The amount of force required to start the first stage is directly related to the amount of overlap of the hook portion 24 and the ledge 26 which can be adjusted using adjustment screw 28 as noted above.

The amount of force required to trigger past the second stage is affected by force of the spring 42 in the disconnector 18 which presses against a ledge on the trigger 12 at its bottom and is compressed for adjustable forward force by the adjustment screw 20 engaged with the disconnector 18 at the top. The more the spring 41 is compressed, the more force will be required to pass the second stage of triggering in which the hammer is totally released from engagement with both the hook portion 24 and the latch portion 30. Once so released the hammer 22 rotates to activate the firing pin firing the rifle. The hammer 22 is spring loaded by other components of the rifle acting on it and therein rotates to operate the firing pin and fire the weapon. This firing operation happens quickly and with the trigger 12 held to the rear by the trigger finger of the user the hammer 22 is rotated back past the cocked position by the bolt carrier of the rifle using expended gas from the fired cartridge. At this point, the arched portion 40 of the hammer 22 contacts the front of the latch portion 24 of the disconnector 18 pushing it in it rotational engagement in the slot 38 of the trigger 12 to the rear. The amount and duration of this contact is of course also adjustable using adjusting screw 21 to rotate the disconnector to varying default portions biased forward by the spring 41. The arched portion 40 of the hammer 22 then slides down the face 48 of the disconnector 18 pushing it to the rear and compressing the spring 41. Of course a means to adjust the forward bias of the disconnector 18 and also its force against the sliding hammer 22 is provided by adjusting screw 20 which may be turned to compress the spring 41 engaged in the disconnector 18 more for more force or less for less force.

When the hammer 22 has rotated enough and slides down past the face 48 the disconnector latch portion 30 latches over the rear ledge portion 32 of the hammer 22 ant holds the hammer 22 to stop it from firing the weapon again. The assembly is again ready to be fired.

The device herein shown in the drawings and described in detail herein disclose arrangements of elements of particular construction and configuration for illustrating preferred embodiments of structure and method of operation of the present invention. It is to be understood, however, that elements of different construction and configuration and other arrangements thereof, other than those illustrated and described, may be employed to provide the adjustable trigger mechanism for the family of AK-47 rifles in accordance with the spirit of this invention. Further, some adjustments provided by the device might be used without others and still yield a significant performance and utility increase over current trigger device available for such a purpose. All such changes, alternations and modifications as would occur to those skilled in the art are considered to be within the scope of this invention as broadly defined in the appended claims.

As such, while the present invention has been described herein with reference to particular embodiments thereof, a latitude of modifications, various changes and substitutions are intended in the foregoing disclosure, and will be appreciated that in some instance some features of the invention will be employed without a corresponding use of other features without departing from the scope of the invention as set forth in the following claims.

What is the claimed is:

1. A trigger mechanism adapted for installation into the receiver of an AK47-rifle comprising:

a trigger, said trigger adapted for rotational attachment to a pin engaging the receiver of said AK-47;

said trigger having trigger lever;

said trigger having a slot formed therein sized to accommodate a disconnector;

said disconnector rotatable upon said pin from a first position to a second position closest to a trigger hook;

said trigger having a hook portion adapted for engagement with a ledge portion of a rotationally mounted hammer communicating with a firing mechanism of said AK-47;

said hammer rotatable from a cocked position to a firing position activating said firing mechanism by a means to bias said hammer to said firing position;

said trigger having trigger lever;

said trigger having a slot formed therein sized to accommodate a disconnector;

said disconnector rotatable upon said pin from a first position to a second position closest to said trigger hook portion;

said trigger having an engaged position biased toward said disconnector with said hook portion having a surface engaged with a ledge on said hammer thereby holding said hammer in said cocked position;

an adjustment screw translateably engaged in said trigger at a position behind said lever, said adjustment screw adjustable to protrude varying distances from said trigger thereby providing a means for adjustment of the amount of surface of said hook portion engaged with said ledge;

means to bias said disconnector to rotate on said pin toward said second position; and said trigger moveable from said engaged position to a disengaged position by application of force to said trigger lever thereby rotating it upon said pin and disengaging said surface of said hook position with said ledge, wherein pulling said trigger lever with a finger will disengage said trigger from said hammer allowing said hammer to rotate and fire AK-47.

2. The trigger mechanism of claim 1 additionally comprising:

means to adjust the force imparted by said means to bias said disconnector to rotate on said pin.

3. The trigger mechanism of claim 2 additionally comprising:

means to adjust the distance of rearward travel of said trigger lever past said disengaged position.

4. The trigger mechanism of claim 3 additionally comprising:

means to adjust the distance of rotation of said disconnector toward said second position.

5. The trigger mechanism of claim 4 wherein a means to adjust the distance of rearward travel of said trigger lever past said disengaged position comprises:

a second screw cooperatively engaged in said trigger in front of said trigger lever; and said second screw adjustable by rotation to contact said receiver at varying lengths of protrusion from said trigger.

6. The trigger mechanism of claim 4 wherein said means to adjust the force imparted by said means to bias said disconnector to rotate on said pin comprises:

a spring cooperatively engaged in a passage in said disconnector;

said spring contacting the surface of said trigger through a bottom end of said passage;

a compression screw engaged at a top end of said passage; and said screw rotatable into said passage toward and away from said bottom end to thereby adjustably compress said spring.

7. The trigger mechanism of claim 3 wherein said means to adjust the force imparted by said means to bias said disconnector to rotate on said pin comprises:

a spring cooperatively engaged in a passage in said disconnector;

said spring contacting the surface of said trigger through a bottom end of said passage;

a compression screw engaged at a top end of said passage; and said screw rotatable into said passage toward and away from said bottom end to thereby adjustably compress said spring.

8. The trigger mechanism of claim 7 wherein a means to adjust the distance of rearward travel of said trigger lever past said disengaged position comprises:

a second screw cooperatively engaged in said trigger in front of said trigger lever; and said second screw adjustable by rotation to contact said receiver at varying lengths of protrusion from said trigger.

9. The trigger mechanism of claim 3 wherein a means to adjust the distance of rearward travel of said trigger lever past said disengaged position comprises:

a second screw cooperatively engaged in said trigger in front of said trigger lever; and said second screw adjustable by rotation to contact said receiver at varying lengths of protrusion from said trigger.

10. The trigger mechanism of claim 2 additionally comprising:

means to adjust the distance of rotation of said disconnector toward said second position.

11. The trigger mechanism of claim 2 wherein said means to adjust the force imparted by said means to bias said disconnector to rotate on said pin comprises:

a spring cooperatively engaged in a passage in said disconnector;

said spring contacting the surface of said trigger through a bottom end of said passage;

a compression screw engaged at a top end of said passage; and said screw rotatable into said passage toward and away from said bottom end to thereby adjustably compress said spring.

12. The trigger mechanism of claim 2 additionally comprising:

a replacement hammer, said hammer sized to operatively replace said hammer; and said replacement hammer having a single ledge portion positioned to contact single hook portion on said trigger.

13. The trigger mechanism of claim 1 additionally comprising:

means to adjust the distance of rearward travel of said trigger lever past said disengaged position.

14. The trigger mechanism of claim 13 additionally comprising:

means to adjust the distance of rotation of said disconnector toward said second position.

15. The trigger mechanism of claim 14 wherein said means to adjust the distance of rearward travel of said trigger lever past said disengaged position comprises:

a second screw cooperatively engaged in said trigger in front of said trigger lever; and said second screw adjustable by rotation to contact said receiver at varying lengths of protrusion from said trigger.

16. The trigger mechanism of claim 13 wherein said means to adjust the distance of rearward travel of said trigger lever past said disengaged position comprises:

a second screw cooperatively engaged in said trigger in front of said trigger lever; and said second screw adjustable by rotation to contact said receiver at varying lengths of protrusion from said trigger.

17. The trigger mechanism of claim 1 additionally comprising:

means to adjust the distance of rotation of said disconnector toward said second position.

18. The trigger mechanism of claim 1 additionally comprising:

a replacement hammer, said hammer sized to operatively replace said hammer; and said replacement hammer having a single ledge portion positioned to contact single hook portion on said trigger.

* * * * *